US005311821A

United States Patent [19]

Lang et al.

[11] Patent Number: 5,311,821

[45] Date of Patent: May 17, 1994

[54] RAIL VEHICLE HAVING SUPPLEMENTARY SPRING PROVIDING THE RESTORING MOMENT AT HIGH ANGLES OF BODY ROLL

[75] Inventors: Hans P. Lang, Harburg; Alfred Uttner, Donauworth, both of Fed. Rep. of Germany

[73] Assignee: Man GHH Schienenverkehrstechnik GmbH, Nuremberg, Fed. Rep. of Germany

[21] Appl. No.: 919,020

[22] Filed: Jul. 23, 1992

[30] Foreign Application Priority Data

Nov. 27, 1990 [DE] Fed. Rep. of Germany ..... 4037672

[51] Int. Cl.[5] ..... B61F 5/50

[52] U.S. Cl. ..... 105/199.2; 105/453

[58] Field of Search ..... 105/199.1, 199.2, 453

[56] References Cited

U.S. PATENT DOCUMENTS

| | | | |
|---|---|---|---|
| 3,731,638 | 5/1973 | Tack | 105/199.2 |
| 3,795,201 | 3/1974 | Tack | 105/199.2 |
| 4,355,582 | 10/1982 | Germer | 105/199.2 X |
| 4,357,879 | 11/1982 | Mohacsi et al. | 105/199.1 |
| 4,516,507 | 3/1985 | Dean, II | 105/199.2 |
| 4,665,835 | 5/1987 | Mohacsi et al. | 105/199.2 |
| 5,172,819 | 12/1992 | Daugherety, Jr. | 213/75 |

FOREIGN PATENT DOCUMENTS

| | | | |
|---|---|---|---|
| 365753 | 1/1959 | Fed. Rep. of Germany . | |
| 3510454 | 3/1985 | Fed. Rep. of Germany . | |
| 3740244 | 11/1987 | Fed. Rep. of Germany . | |
| 3806581 | 12/1988 | Fed. Rep. of Germany . | |
| 4037672 | 6/1992 | Fed. Rep. of Germany . | |
| 2497167 | 12/1981 | France . | |
| 2593455 | 1/1987 | France . | |
| 1381699 | 1/1975 | United Kingdom | 105/199.2 |
| 2021053 | 4/1979 | United Kingdom . | |

*Primary Examiner*—Robert J. Oberleitner
*Assistant Examiner*—S. Joseph Morano
*Attorney, Agent, or Firm*—Thomas R. Morrison

[57] ABSTRACT

In a railway vehicle with a secondary spring arrangement acting between the chassis and the vehicle body which generates a continuously increasing restoring moment at a relative inclination between the two units until the maximum permissible angle of roll is reached, according to the invention a permissible limitation of the angle of roll is achieved without any adverse effect on the derailing limit and ride comfort on straights in a structurally simple and reliable manner, in that the spring arrangement is comparatively soft and there is a passively acting supplementary spring with a limited range of rotation (rotation play coupling) connected in parallel to the spring arrangement, which operates virtually without restoring moment in a partial range of slight roll angle movements, and at greater deviations of the roll angle within the permissible range, generates a steeply increasing restoring moment which is many times greater than that of the spring arrangement at the maximum permissible angle of body roll.

6 Claims, 3 Drawing Sheets

RAIL VEHICLE HAVING SUPPLEMENTARY SPRING PROVIDING THE RESTORING MOMENT AT HIGH ANGLES OF BODY ROLL

The invention refers to roll stability of a rail vehicle.

Due to increasing running speeds and need for improved riding comfort, high demands are being made on the running behavior of rail vehicles. A high degree of running comfort requires that the running gear and the car body are largely decoupled, to allow the running gear to follow the rail elastically and with as few obstructions as possible in the straight track. This in turn requires soft spring suspension of the car body, as for example by means of two air springs arranged laterally between the car body and the running gear, which in addition to providing roll suspension can also support the car body vertically at the running gear.

However, such a soft secondary spring suspension leads to roll angle deflections when quasi-static centrifugal force accelerations occur, for example when the vehicle is running too fast in a curve, or if the vehicle is standing on a superelevated track. On the other hand, it is essential that narrow tolerances be observed for the maximum roll angle, not only because passengers regard a steep tilt of the car body in curves as unpleasant, but also especially for reasons of safety, since the permissible clearance for structures must not be exceeded under any circumstances.

It is known to use controllable air springs for the soft secondary spring suspension of the car body. Appropriate adjustment of the air pressure of the individual air springs allows not only the regulation of the height level, but also limiting of the tilt of the car body. However, such air spring systems can only be used to equalize static or quasi-static changes of position between the running gear and the car body. They cannot effectively stabilize dynamic roll movements because of the inertia of the air pressure adjustment—due to the system design—, and these cause the car body to sway excessively, for example when the car is going into a fast curve. Effective that air pressure adjustment of air springs, which depends on the roll angle, also has the drawback of involving undesirably high consumption of air.

Also known in connection with controlled secondary air spring systems are passively reacting roll stabilizers in the form of torsion rod springs. In these, the air springs are interconnected for vibration, their control does not depend on the roll angle, and they are meant only to equalize the height level changes based on different loads, while the car body tilt is limited only by the roll stabilizers. Their spring characteristic line is determined by the maximum permissible roll angle during high running speed in a curve, and even when running in a straight track, they cause a close coupling of running gear and car body which has a negative effect on riding comfort and vertical wheel force dynamics. An additional factor is that controllable running gear or truck air springs require the installation of emergency springs which take over the spring suspension of the car body when the air supply is interrupted and provide a considerably harder suspension. The greater stiffness of these emergency springs in conjunction with the great torsional stiffness of the car body has the effect that the vehicle reacts to turns in the track by perceivable wheel discharge. Thus when the car rides on emergency springs, the additional stiffening between the running gear and the car body caused by passively reacting roll stabilizers to limit the car body tilt in curves, leads to a considerable impairment of derailment protection.

Even with the secondary spring arrangement known from DE-OS 34 07 574, in which the car body is supported at the trucks by means of a spring suspension whose control depends on the roll angle, and in which only one of the trucks is connected with the car body via a passively reacting roll stabilizer, the above described disadvantages cannot be effectively eliminated. On the one hand the roll return moment with this arrangement is distributed extremely unevenly to both trucks in a fast curve and must be largely compensated by the wheel force differences of only one truck, which causes a great quasi-static wheel discharge at the inside wheels. On the other hand due to the roll stabilizer, the car body is coupled so strongly with the truck—caused by the higher frequency dynamic roll movements in the straight track, that two differently equipped trucks are necessary for the car body.

An object of the invention is to develop a rail vehicle of the required type in such a way that by providing spring suspension between the car body and the running gear, a safe limitation of the car body tilt to a predetermined roll angle range is achieved without impairing derailment protection and riding comfort in the straight track.

In accordance with the invention it is ensured—by combining a relatively soft secondary spring arrangement, for example in the form of a multipoint air spring support controlled by the roll angle, with a supplementary spring which is largely without effect in the lower partial range of the permissible roll movement and engages only beyond this range, but then produces a steeply rising return moment—that the dynamic roll movements of the car body while running in a straight track, and the roll angle deflections of the running gear in a curved track as well as during a slow run on an incline are almost totally absorbed by the secondary spring arrangement, while the supplementary spring does not respond, so that even when using a relatively stiff primary spring suspension, the vibrational decoupling of running gear and car body—necessary to achieve a high degree of riding comfort—is achieved without impairing the wheel force dynamics. This decoupling is effected while reliably maintaining the permissible roll angle limit, especially in fast curves or on inclines, since the return moment of the supplementary spring becomes effective independently of the response speed of an air spring control, and without a wheel discharge that would be critical for derailment protection.

To improve the running behavior even further, it is practical for the characteristic line of the supplementary spring in the above mentioned working range of low roll angle deflections to run essentially along the return moment reference line.

To achieve a structurally simple, robust and fail-safe supplementary spring, the spring is designed in a further advantageous embodiment of the invention as a torsion spring bar acting between the running gear and the car body, with a limited rotational play, in such a way that it is practical for the control levers—which are twisted in opposite directions when the car body and the running gear are tilted—to be connected with the torsion spring bar via a claw striker coupling that has rotational play. To allow the installation of the control levers in the correct rotational position in relation to the torsion spring bar without difficult adjustments when the supplementary spring is installed, it is practical to provide centering springs to center the claw striker coupling in the middle position of the rotational play, although the spring effectiveness of these centering springs is negligibly small in comparison with the spring arrangement that is effective between the car body and the running gear.

To achieve an easy rotational play between the torsion spring bar and the control levers, it is practical for the levers to be able to pivot to a limited extent with low friction, preferably by means of a maintenance-free slide bearing.

The roll angle range in which the torsion spring bar does not engage generally extends only over a fraction of the maximum permissible roll angle deflections, but it is highly dependent on the external marginal conditions of each individual installation, and it is therefore a particular advantage when it is variably adjustable.

Another essential aspect of the invention results from a controlled air spring arrangement with an associated emergency spring suspension which provides the car body support and roll angle stabilization if the air supply is interrupted, providing a considerably harder suspension, due to its construction. In that case, the problems with derailment protection described in the beginning are solved in an extremely simple and effective manner by ensuring that all roll movements occurring while running with the emergency spring suspension, remain within the limited rotational play or within the area of negligibly small spring hardness of the supplementary spring.

A embodiment of the invention will now be described in detail with reference to the following greatly simplified drawings which are attached:

Figure 1:
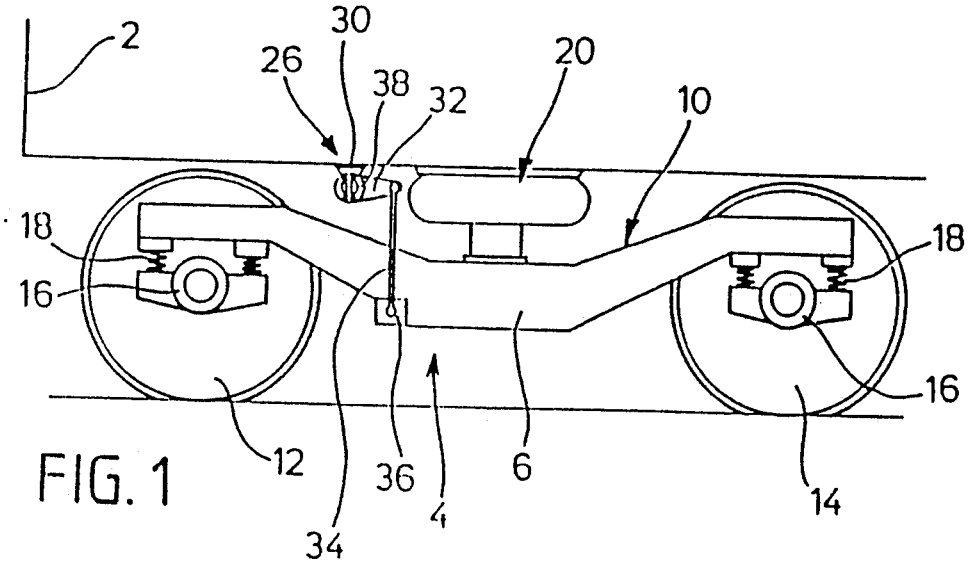
FIG. 1 shows a lateral view of the truck of a rail vehicle near one of the ends of said vehicle.
Figure 2:
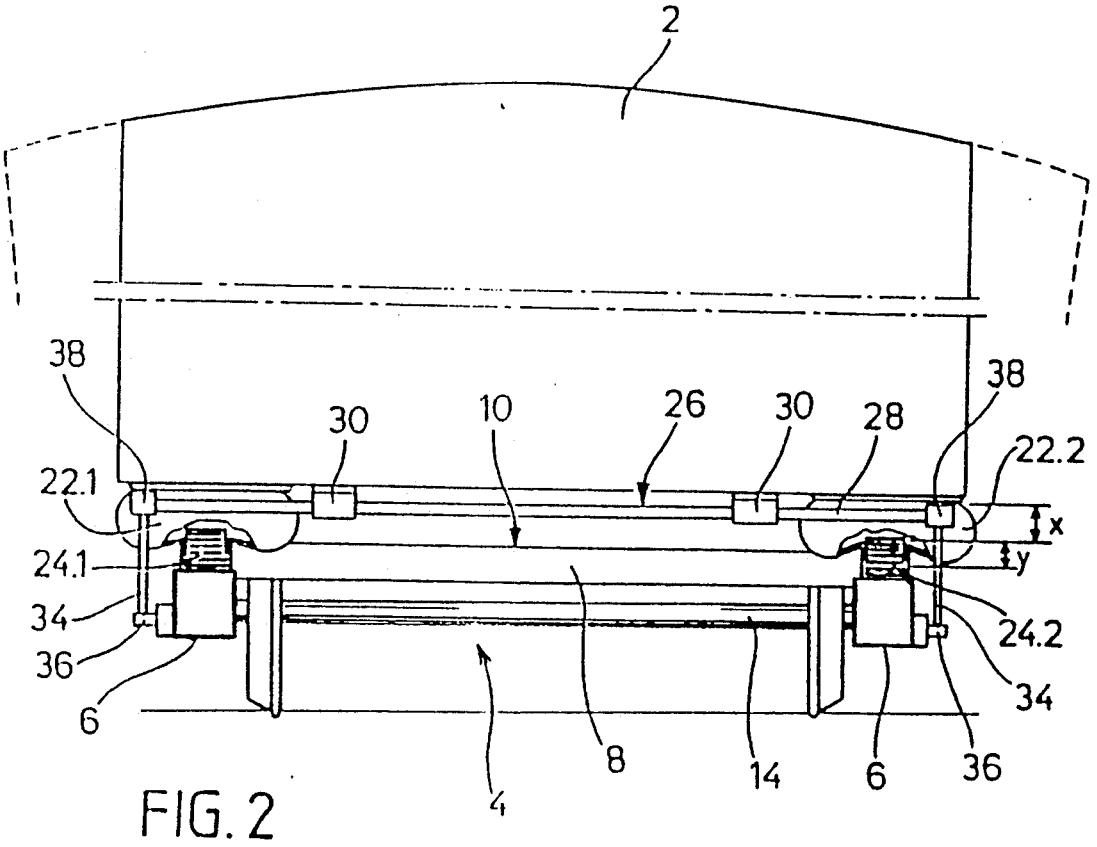
FIG. 2 shows a partly cut-out view of the air, supplementary and emergency springs of the rail vehicle, according to FIG. 1.

The running gear of the rail vehicle shown in FIG. 1 and 2 is designed in the form of two identical trucks 4 which support the car body 2 at the ends of the car body (only one is shown), each truck containing an H-shaped truck frame 10, consisting of rigidly connected longitudinal and cross members 6, 8, which carries the two rigid wheelsets 12, 14 of truck 4 via wheelset bearing housing 16 and primary spring suspension 18, which has elastic character in three dimensions and has relatively great spring hardness in a vertical direction.

The secondary spring suspension effective between car body 2 and truck 4 consists of a pressure-controlled air spring arrangement 20 in the form of air springs 22.1 and 22.2 of relatively low spring hardness laterally arranged between the underside of the car body and the longitudinal truck members 6, which support the car body 2 at the truck frame 10 and are controlled in such a way that they keep the floor at a constant level regardless of the load carried by car body 2 and which produce a return moment acting against the roll movement when the car body 2 and the truck frame 10 are tilted. Elastic deformation x of the air springs 22 in comparison with the zero tilt position of the car body is predetermined by the maximum permissible roll angle at which car body 2 is tilted to the right or to the left up to the border profile shown as dotted lines in FIG. 2. The air springs 22 are designed in such a way that they do not interfere with the turn-out movements of the truck 4, as for example about a king pin bearing (not shown) situated in the middle of the frame.

Spring arrangement 20 is provided with an emergency spring suspension 24 consisting of passively reactive emergency springs 24.1 and 24.2 integrated into air springs 22, for example in the form of rubber sleeve elements on which car body 2 is supported with a movable roll angle when the air springs 22 fail or the air supply is interrupted. Due to the construction, the emergency springs 24.1 and 24.2 have a considerably shorter elastic deformation y and many times the spring hardness of air springs 22. Accordingly the roll movements occurring while the car is riding on the emergency springs 24 are considerably less than the permissible roll angle deflections during elastic deformation x with air spring arrangement 20.

In addition to the spring arrangement 20 and the emergency spring suspension 24, a passively reacting supplementary spring 26 is installed between car body 2 and truck frame 10; it reacts exclusively to roll movements of the car body 2, but not to its changes in height; its peculiarity consists in a non-linear spring characteristic line which runs in such a way that the supplementary spring 26 is largely ineffective in the dynamically optimal range of low roll angle movements, producing a return moment which opposes the tendency of the car body 2 to roll only in the upper portion of the permissible roll angle deflections where, however, it rises sharply.

Figure 3:
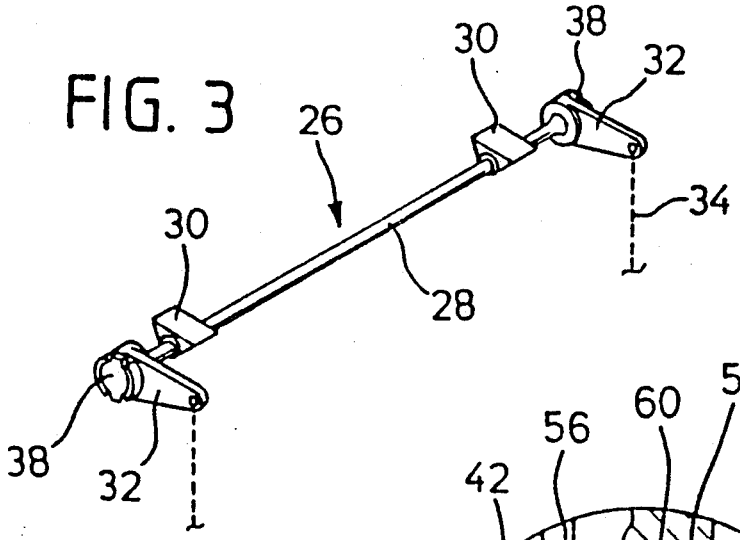
FIG. 3 shows a perspective view of a supplementary spring designed as a torsion spring bar.
Figure 4:
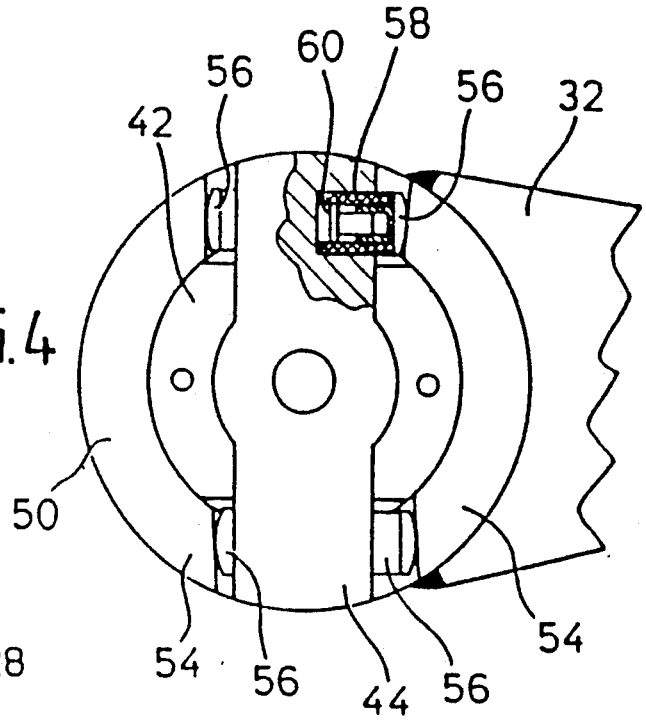
FIG. 4 shows a partly cut-out view of a claw striker coupling with rotational play, between a control lever and the torsion spring bar according to FIG. 3.
Figure 5:
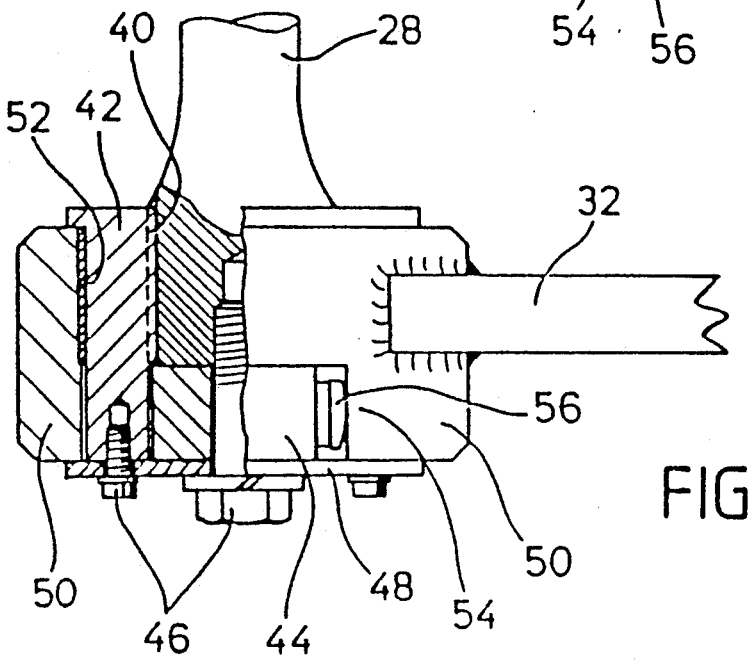
FIG. 5 shows the partly cut-out top view of the claw striker coupling according to FIG. 4.

As FIG. 3 to 5 show in detail, the supplementary spring 26 consists of a torsion spring bar 28 which is pivotably mounted about its longitudinal axis by means of bearing supports 30 in the underside of the car body laterally to the running direction. At each end of the torsion spring bar 28 is a control lever 32 whose free lever end is flexibly connected with the longitudinal truck member 6 via a control bar 34 and a king pin 36.

To ensure that the return effect of the roll stabilizer formed by the supplementary spring 26 begins only during greater roll angle deflections within spring path x of air spring suspension 20, an appropriate claw striker coupling 38 with rotational play is provided between the control levers 32 and each torsion spring bar end. As FIG. 4 and 5 show in detail, coupling 38 contains a bearing sleeve 42 rigidly connected with the torsion spring bar end and a double-armed striker 44 which engages without play and positively in the front recess of bearing sleeve 42; these are fastened interchangeably at the head end of torsion spring bar 28 by means of screw fittings 46 and a bracket plate 48. Arranged on the bearing sleeve 42 is the center hub 50 of control lever 32, axially immovable but easily rotatable via a slide bearing 52.

For coupling the rotational moment the lever hub 50 is provided in the front with coupling claws 54 whose flank play in relation to the striker corresponds to the desired rotational play.

The rotational or flank play between striker 44 and coupling claws 54 is limited by tappets 56 laterally slide-able along striker 44; these are held by rubber springs 58 of very low spring hardness in a crowned arrangement at the claw flanks of lever hub 50. In this manner the control lever 32 is centered in the center position for rotational play—shown in the upper portion of FIG. 4. When the control lever 32 is turned in relation to the torsion spring bar 28, the tappets 56 are moved in the assigned guidance hole of strike 44 until one or the other pair of diametrically opposite tappets 56, depending on the rotational direction, comes to rest with its back 60 against the striker guidance hole and the control lever 32 is rigidly coupled with the torsion spring bar end. The final position of the rotational play is shown in the lower half of FIG. 4. The magnitude of torsional play determines the working range of the supplementary spring 26 without reverse moment—disregarding the minute pull-back force of the rubber springs 58—and can either be rigidly predetermined or made adjustable by changing the effective length of each tappet 56 between the front crowned surface and the rear 60 as shown in FIG. 4. By installing the described claw striker coupling 38, a conventional torsion spring roll angle stabilizer without rotational play can be converted into a type with rotational play, i.e. with a non-linear spring characteristic line.

Figure 6:
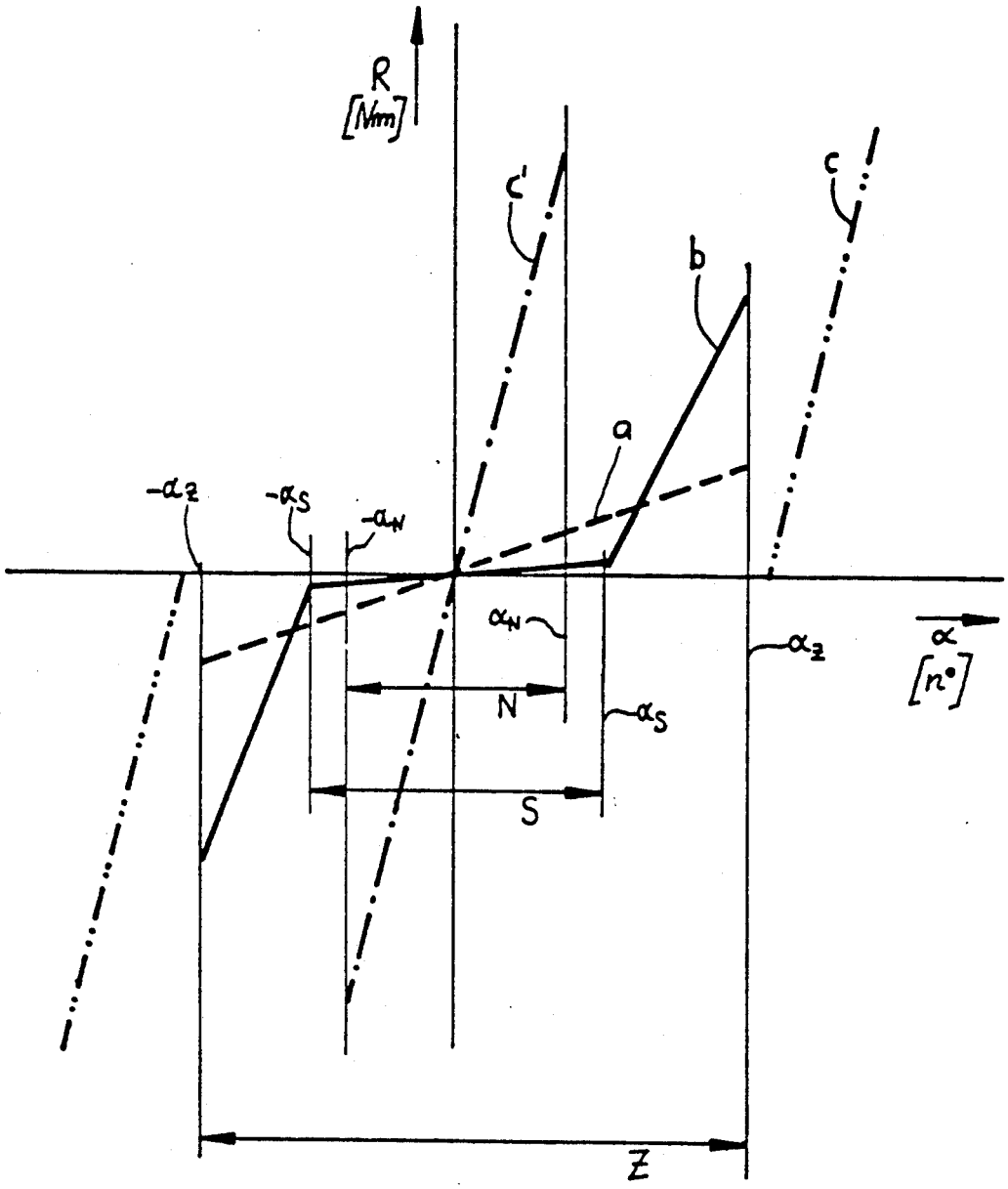
FIG. 6 shows a diagram with the individual characteristic lines of the springs.

The qualitative course of the characteristic line of the individual spring systems is shown in FIG. 6.

While the air spring suspension 20 causes an overall reliable roll angle area z between $+\alpha_Z$ and $-\alpha_Z$ with a relatively slightly inclined spring characteristic line, i.e. a soft coupling between car body 2 and truck frame 10 in terms of the roll movements, the non-linear spring characteristic line b of the torsion supplementary spring 26 in the lower portion S of low roll angle deflections runs almost without return moment between $+\alpha_S$ and $-\alpha_S$, depending on the rotational play of the claw striker coupling 38, while in the upper portion of greater roll angle movements between $\alpha_S$ and $\alpha_Z$, it rises sharply in such a way that the supplementary spring 26 when approaching the maximum permissible roll angle $\pm a_Z$ produces a return moment R that is many times higher than that produced by the air spring suspension 20. The emergency springs 24 have an even greater hardness, but they do not engage during a ride on the air spring suspension, as indicated in FIG. 6 by the emergency spring characteristic line c.

In the lower roll angle area S are the dynamic roll movements of the car body 2 while running on a straight track, the roll movements of truck 4 while running on a curved track, and the truck tilt during a slow run on an incline. In this area S the return movements R opposing the roll movements are produced almost exclusively by the relatively soft air spring arrangement 20.

The engagement range of supplementary spring 26 between S and Z is reached during a fast run on air spring suspension in curves and on inclines. In this the roll angle $\alpha$ is effectively limited to the maximum permissible value $\alpha_Z$ by the joint return effect of air spring suspension 20 and the much harder supplementary spring 26, while the response time of the air spring regulation is without concern, and the air consumption is minimal.

In case of an air spring failure, the emergency springs 24 are engaged according to spring characteristic line c' and limit the roll angle movements of the car body 2 to an area N, which lies within the partial area S (essentially without reverse moment) of the supplementary spring characteristic line b, so that the torsion spring bar 28 supplies no additional return moment R during a ride on the emergency springs, and the derailment protection is therefore not impaired.

We claim:

1. In a rail vehicle which comprises a car body, and running gear on which the car body is supported, stabilizer apparatus for countering tilting movements of the car body relative to the running gear in a range of such movements from low angle to high angle tiltings, the stabilizer apparatus including suspension means comprising pressure controlled air springs supporting the car body on the running gear, and an elongated torsion spring supported from one of the car body and the running gear, the torsion spring being connected at each of opposite ends thereof to the other of the car body and running gear by levers mounted at a first lever end on the said torsion spring opposite ends, with there being control rods extending from second ends of the levers to the said other of the vehicle car body and running gear, the pressure controlled air springs being operable to apply a stabilizing moment to counter car body low angle tilting movements, the first lever ends being connected to the torsion spring opposite ends with a coupling element, the coupling element including means for providing limited rotational play of the levers relative to the torsion spring in each of two opposite directions from a normal lever centered position and wherein during said limited rotational play a stabilizing moment applied by the torsion spring to counter body low angle tilting movements is less than that applied by the pressure controlled air springs, said providing means embodying a lever stopped position wherein the levers and the torsion spring are rigidly coupled so that the torsion spring applies a stabilizing moment for countering car body high angle tilting movements which is greater than any stabilizing moment the pressure controlled air springs can apply to counter said high angle tilting movements.

2. The stabilizer apparatus of claim 1 in which the coupling element is a claw striker coupling, the normal centered position of the levers being maintained with centering springs carried in the coupling element, the limited rotational play of the levers being effected in opposition to a bias of the centering springs.

3. The stabilizer apparatus of claim 2 in which the limited rotational play in movement of the levers from normal centered position to stopped position is continually adjustable to impart increasing rigidity to the coupled lever torsion rod spring connection as the levers approach stopped position.

4. The stabilizer apparatus of claim 1 in which the levers are mounted to the torsion rod spring to pivot relative thereto with low friction.

5. The stabilizer apparatus of claim 4 in which the lever low friction mounting comprises a maintenance-free slide bearing.

6. The stabilizer apparatus of claim 1 further comprising emergency springs carried between the car body and running gear, said emergency springs being operable upon failure of the controlled air springs to apply a stabilizing moment to counter body tilting movements which is greater than any stabilizing moment the torsion rod spring could apply for countering car body high angle tilting movements.

* * * * *